US011877618B2

(12) United States Patent
Chambers et al.

(10) Patent No.: US 11,877,618 B2
(45) **Date of Patent: *Jan. 23, 2024**

(54) FOOTWEAR SOLE PLATE WITH FOREFOOT THROUGH HOLE

(71) Applicant: NIKE, Inc., Beaverton, OR (US)

(72) Inventors: Clayton Chambers, Portland, OR (US); John Droege, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/083,649

(22) Filed: Dec. 19, 2022

(65) Prior Publication Data

US 2023/0124843 A1 Apr. 20, 2023

Related U.S. Application Data

(60) Continuation of application No. 17/227,587, filed on Apr. 12, 2021, now Pat. No. 11,559,104, which is a (Continued)

(51) Int. Cl.
*A43B 13/14* (2006.01)
*A43B 13/12* (2006.01)
(Continued)

(52) U.S. Cl.
CPC ..... *A43B 13/146* (2013.01); *A43B 3/0036* (2013.01); *A43B 7/1425* (2013.01);
(Continued)

(58) Field of Classification Search
CPC ..... A43B 13/14; A43B 13/12; A43B 13/16; A43B 13/146; A43B 13/125;
(Continued)

(56) References Cited

U.S. PATENT DOCUMENTS 1,741,419 A * 12/1929 Jones ..... A43B 7/14 36/43
2,150,779 A * 3/1939 Nickerson ..... A43B 23/22 36/182
(Continued)

FOREIGN PATENT DOCUMENTS

CN 1905814 * 1/2007
CN 205082769 * 3/2016
(Continued)

*Primary Examiner* — Ted Kavanaugh
(74) *Attorney, Agent, or Firm* — Quinn IP Law

(57) ABSTRACT

A sole structure for an article of footwear may have a midsole system that includes a sole plate having a forefoot region and a midfoot region. The sole plate may have a foot-facing surface and a ground-facing surface opposite to the foot-facing surface. The sole plate may define a through hole extending from the foot-facing surface to the ground-facing surface in the forefoot region. The through hole may be closer to a medial edge of the sole plate than to a lateral edge of the sole plate. The sole plate may have ridges extending longitudinally in the midfoot region and in the forefoot region. The ridges may have crests at least some of which may extend non-parallel with one another in a longitudinal direction of the sole plate.

20 Claims, 9 Drawing Sheets

Related U.S. Application Data division of application No. 16/395,592, filed on Apr. 26, 2019, now Pat. No. 11,006,695.

(60) Provisional application No. 62/678,499, filed on May 31, 2018.

(51) Int. Cl.

| | |
|---|---|
| ***A43B 3/00*** | (2022.01) |
| ***A43B 13/02*** | (2022.01) |
| ***A43B 13/18*** | (2006.01) |
| ***A43B 7/1425*** | (2022.01) |
| ***A43B 7/1445*** | (2022.01) |
| ***A43B 13/16*** | (2006.01) |

(52) U.S. Cl.

CPC ..... *A43B 7/1445* (2013.01); *A43B 13/023* (2013.01); *A43B 13/125* (2013.01); *A43B 13/14* (2013.01); *A43B 13/16* (2013.01); *A43B 13/186* (2013.01)

(58) Field of Classification Search

CPC . A43B 13/0036; A43B 13/023; A43B 13/186; A43B 7/1425; A43B 7/1445

See application file for complete search history.

(56) References Cited

U.S. PATENT DOCUMENTS

| | | | | | |
|---|---|---|---|---|---|
| 2,713,732 | A * | 7/1955 | Guest | A43B 7/14 | 36/167 |
| 4,439,937 | A * | 4/1984 | Daswick | A43B 13/10 | 36/72 A |
| 5,647,145 | A * | 7/1997 | Russell | A43B 7/1445 | 36/31 |
| 6,023,861 | A * | 2/2000 | Bizzotto | A43B 13/12 | 36/179 |
| 8,813,391 | B1 * | 8/2014 | Khaitan | A43B 7/1435 | 36/28 |
| 8,850,718 | B2 * | 10/2014 | Lubart | A43B 13/026 | 36/31 |
| 11,006,695 | B2 * | 5/2021 | Chambers | A43B 13/146 | |
| 11,089,834 | B2 * | 8/2021 | Chambers | A43B 3/0057 | |
| 2003/0150131 | A1 * | 8/2003 | McManus | A43B 7/1445 | 36/28 |
| 2011/0271553 | A1 * | 11/2011 | McCarron | A43B 5/145 | 36/31 |
| 2014/0230272 | A1 * | 8/2014 | Feshbach | A43B 13/20 | 36/28 |
| 2014/0338220 | A1 * | 11/2014 | Stern | A43B 7/142 | 36/43 |
| 2015/0082668 | A1 * | 3/2015 | Nonogawa | A43B 7/144 | 36/30 R |
| 2016/0219974 | A1 * | 8/2016 | Izquieta Anaut | A43B 13/181 | |
| 2016/0353836 | A1 * | 12/2016 | Luedecke | A43B 13/16 | |
| 2017/0354200 | A1 * | 12/2017 | Orand | A43B 13/181 | |
| 2018/0000196 | A1 * | 1/2018 | Lovell | A43B 13/386 | |
| 2019/0350304 | A1 * | 11/2019 | Velazquez | A43B 5/00 | |
| 2019/0365033 | A1 * | 12/2019 | Chambers | A43B 13/10 | |

FOREIGN PATENT DOCUMENTS

| | | | |
|---|---|---|---|
| CN | 205912979 | * | 2/2017 |
| CN | 207400404 | * | 5/2018 |
| EP | 2446763 | * | 5/2012 |
| JP | 2003339405 | * | 12/2003 |
| KR | 100647108 | * | 11/2006 |
| WO | WO2014155511 | * | 10/2014 |

* cited by examiner

FOOTWEAR SOLE PLATE WITH FOREFOOT THROUGH HOLE

CROSS-REFERENCE TO RELATED APPLICATIONS

This application is a continuation of U.S. patent application Ser. No. 17/227,587, filed Apr. 12, 2021, which is a divisional of U.S. patent application Ser. No. 16/395,592, filed Apr. 26, 2019, now U.S. Pat. No. 11,006,695, issued May 18, 2021, which claims the benefit of priority to U.S. Provisional Application No. 62/678,499, filed May 31, 2018, and all of which are incorporated by reference in their entirety.

TECHNICAL FIELD

The present teachings generally include a sole plate for an article of footwear and a midsole system for an article of footwear.

BACKGROUND

Footwear typically includes a sole structure configured to be located under a wearer's foot to space the foot away from the ground. Sole structures may typically be configured to provide one or more of cushioning, motion control, and resiliency.

DESCRIPTION

Figure 1:
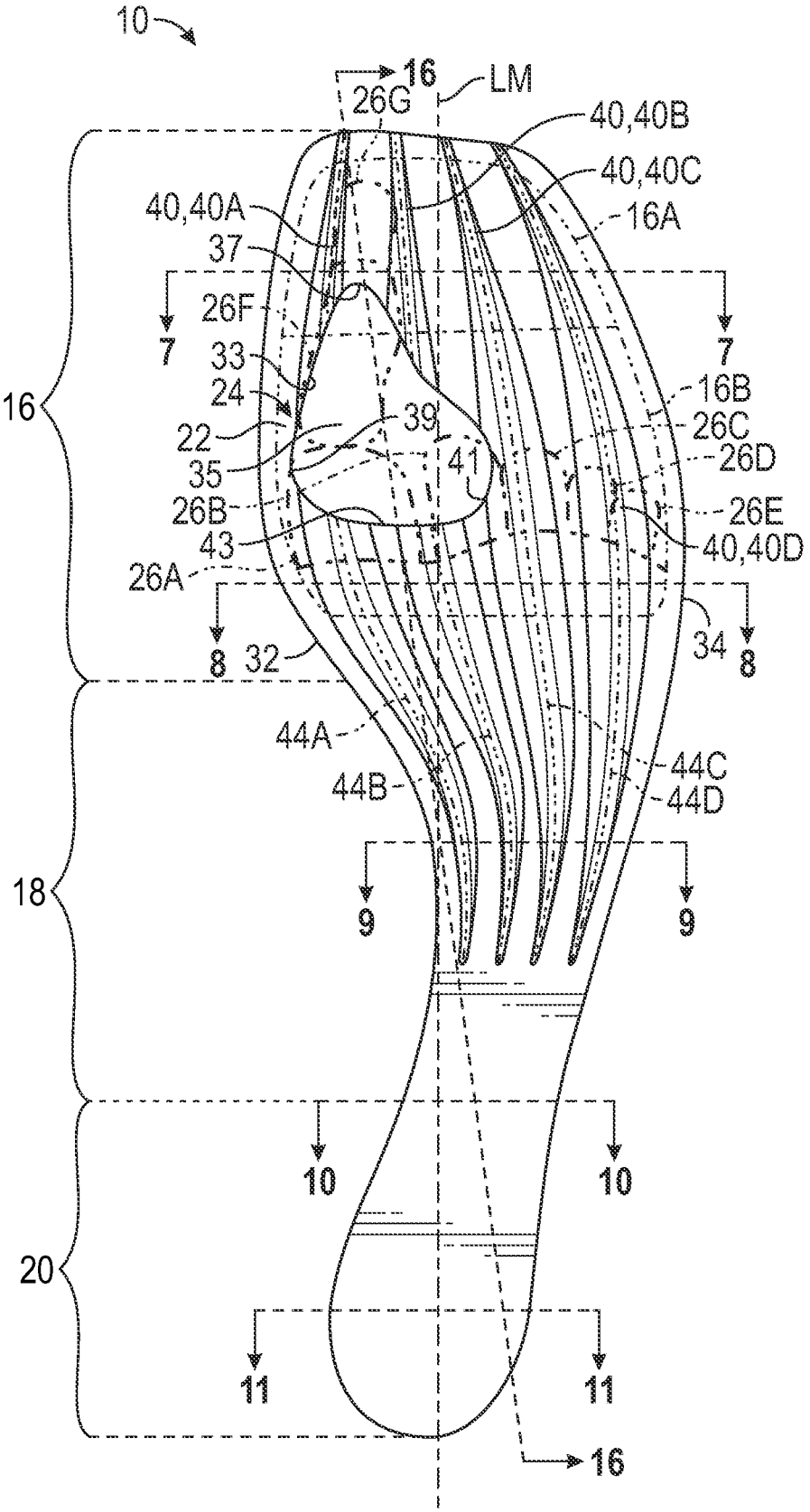
FIG. 1 is a schematic illustration in plan view of a foot-facing surface of a sole plate having a through hole.

A sole structure for an article of footwear comprises a midsole system that includes a sole plate. The sole plate may have a forefoot region and a midfoot region, and may have a foot-facing surface and a ground-facing surface opposite to the foot-facing surface. The sole plate may define a through hole extending from the foot-facing surface to the ground-facing surface in the forefoot region. The through hole may be closer to a medial edge of the sole plate than to a lateral edge of the sole plate.

In one or more embodiments, the through hole may have an irregular shape that tapers in width in a forward direction. The through hole may be configured to underlie first and second metatarsal heads and a hallux of a wearer.

In one or more embodiments, the midsole system may further include a first foam layer secured to the foot-facing surface and overlaying the through hole. The midsole system may also include a second foam layer secured to the ground-facing surface and underlying the through hole. The first foam layer and the second foam layer may resiliently deform under a dynamic compressive load and may return energy upon removal of the dynamic compressive load. The first foam layer may be compressed against the second foam layer at the through hole under the dynamic compressive load. The first foam layer and the second foam layer may be compressed against the sole plate away from the through hole under the dynamic compressive load. The resilient deformation and the energy absorption may thus be different at the through hole than away from the through hole. For example, greater deformation may be experienced at the through hole as the foam layers may have less compressive stiffness than the sole plate. A softer cushioning feel may be experienced by a foot supported on the sole structure at the through hole (i.e., above the through hole) than away from the through hole.

The first and second foam layers may be portions of a single component, such as a unitary resilient foam midsole in which the sole plate is embedded. For example, the first and second resilient foam midsole layers may be an upper portion and a lower portion of a single resilient foam midsole surrounding the sole plate, and in one embodiment, may be formed by injecting foam around the sole plate. Alternatively, the first and second foam layers may be separate layers having different compressive stiffnesses. The first foam layer may be stiffer than the second foam layer, or may be less stiff than the second foam layer. The first foam layer and the second foam layer may be the same material or may be different materials.

In one or more embodiments, the sole plate may have a greater compressive stiffness than the first foam layer and may have a greater compressive stiffness than the second foam layer. For example, in one or more embodiments, the sole plate may be one of a fiber strand-lain composite, a carbon-fiber composite, a thermoplastic elastomer, a glass-reinforced nylon, wood, or steel. Accordingly, the midsole system may be tuned to provide different energy return at the through hole than away from the through hole. Dynamic compressive loading on the first resilient sole layer may be reacted with greater energy absorption at the through hole where the first and second foam layers interact with one another than away from the through hole where the first and second resilient sole layers react against the sole plate.

The sole plate may be tuned for stiffness, energy absorption, and direction of energy return with any or all of a varying thickness, non-parallel, longitudinally-extending ridges, and a generally spoon-shaped forefoot portion. In one or more embodiments, the foot-facing surface may be concave in a longitudinal direction of the sole plate in the forefoot region, and the ground-facing surface may be convex in the longitudinal direction of the sole plate in the forefoot region. In one or more embodiments, the sole plate may further include a heel region, and may be a unitary, one-piece component. Additionally, the sole plate may slope in the longitudinal direction in the midfoot region from the heel region to the forefoot region. The sole plate may be biased to this spoon shape in the forefoot region. Bending of the sole plate in the longitudinal direction during dorsiflexion may store energy that is released after toe-off, with the sole plate unbending to its original biased, spoon shape at least partially in the direction of forward motion.

In one or more embodiments, the foot-facing surface may have ridges extending longitudinally in the midfoot region and in the forefoot region. The ground-facing surface may have grooves extending longitudinally in correspondence with the ridges. The ridges and the grooves may be configured such that a thickness of the sole plate from the foot-facing surface to the ground-facing surface varies at a transverse cross-section the sole plate through the ridges, or varies along a length of at least one of the ridges, or varies at both the transverse cross-section and along the length of the at least one of the ridges. The ridges, grooves, and a varied thickness as described may tune the stiffness and energy absorption of the sole plate for different zones while permitting a unitary, one-piece component of uniform material. The sole plate may function as a stiffness modifier within the sole structure.

In one or more embodiments, the ridges may have crests, and at least some of the crests may extend non-parallel with one another in a longitudinal direction of the sole plate. The grooves may also have crests, and at least some of the crests of the grooves may extend non-parallel with one another in the longitudinal direction. Because the ridges may be non-parallel, the wavelengths can be different at different transverse cross-sections through the sole plate. Generally, ridges with shorter wavelengths are stiffer in compression than ridges with longer wavelengths.

In one or more embodiments, a lateral-most one of the ridges may curve in the longitudinal direction to follow a curved lateral edge of the sole plate, and a medial-most one of the ridges may curve in the longitudinal direction to follow a curved medial edge of the sole plate.

In one or more embodiments, the ridges may have crests at least some of which vary in amplitude in a longitudinal direction of the sole plate such that the amplitude of the crests of the ridges is greater in a zone of the sole plate configured for relatively high compressive loads than in a zone of the sole plate configured for relatively low compressive loads. For example, at least some of the crests may have an amplitude that is greater in a rearward portion of the forefoot region than in a forward portion of the forefoot region, and also greater than in the midfoot region. The rearward portion may be configured to underlie the metatarsal-phalangeal joints of a wearer, thus increasing stiffness and energy-absorbing capability where loading is greatest.

In one or more embodiments, the transverse cross-section may be a first transverse cross-section of the sole plate in the midfoot region, and the undulating profile of the sole plate at the first transverse cross-section may include a first set of multiple waves having crests at the ridges and having troughs between respective adjacent ones of the ridges. The undulating profile of the sole plate at a second transverse cross-section of the sole plate in the forefoot region may include a second set of multiple waves having crests at the ridges and having troughs between respective adjacent ones of the ridges. Waves of the first set may each have a first wavelength. Waves of the second set may each have a second wavelength greater than the first wavelength. A lateral-most one of the ridges may curve in the longitudinal direction to follow a curved lateral edge of the sole plate. A medial-most one of the ridges may curve in the longitudinal direction to follow a curved medial edge of the sole plate.

In one or more embodiments, the sole plate may be a resilient material such that the crests of the ridges decrease in elevation from a steady state elevation to a loaded elevation under a dynamic compressive load and return to the steady state elevation upon removal of the dynamic compressive load. For example, the sole plate may be one of a fiber strand-lain composite, a carbon-fiber composite, a thermoplastic elastomer, a glass-reinforced nylon, wood, or steel. The sole plate may resiliently deform to absorb and return energy. The areas of greater amplitude can absorb more energy than those of less amplitude. When sandwiched between foam layers of less compressive stiffness, such as a resilient foam midsole layer overlying and underlying the sole plate, the foam layers may react against the sole plate when resiliently deforming, so that the sole plate acts as a moderator both of bending stiffness and compressive stiffness of the sole structure.

In one or more embodiments, the foot-facing surface may have an undulating profile at the transverse cross-section that includes multiple waves having crests at the ridges and having troughs between respective adjacent ones of the ridges. The crests at the ridges may be aligned with crests of the grooves. The thickness of the sole plate at the transverse cross-section may be less at the crests of the ridges than between the crests of the ridges and the troughs. The ground-facing surface may be flat between the grooves at the transverse cross-section.

In an aspect of the disclosure, a sole structure for an article of footwear may comprise a midsole system including a sole plate having a forefoot region and a midfoot region. The sole plate has a foot-facing surface and a ground-facing surface opposite to the foot-facing surface. The foot-facing surface may be concave in a longitudinal direction of the sole plate in the forefoot region, and the ground-facing surface may be convex in the longitudinal direction of the sole plate in the forefoot region. The sole plate may define a through hole extending from the foot-facing surface to the ground-facing surface in the forefoot region. The through hole may have an irregular shape that tapers in width in a forward direction and may be closer to a medial edge of the sole plate than to a lateral edge of the sole plate. The midsole system may include a first foam layer secured to the foot-facing surface and overlaying the through hole. The midsole system may also include a second foam layer secured to the ground-facing surface and underlying the through hole. The first foam layer and the second foam layer may resiliently deform under the dynamic compressive load and may return energy upon removal of the dynamic compressive load. The first foam layer may be compressed against the second foam layer at the through hole during dynamic compressive loading. The first foam layer and the second foam layer may be compressed against the sole plate away from the through hole. The resilient deformation and the energy absorption may thus be different at the through hole than away from the through hole.

In one or more embodiments, the foot-facing surface may have ridges extending longitudinally in the midfoot region and in the forefoot region, and the ground-facing surface may have grooves extending longitudinally in correspondence with the ridges. The ground-facing surface may be flat between the grooves at the transverse cross-section. The ridges and the grooves may be configured such that a thickness of the sole plate from the foot-facing surface to the ground-facing surface may vary at a transverse cross-section of the sole plate through the ridges, or may vary along a length of at least one of the ridges, or may vary at both the transverse cross-section and along the length of the at least one of the ridges.

In one or more embodiments, the ridges may have crests, and at least some of the crests may vary in amplitude in a longitudinal direction of the sole plate such that the amplitude may be greater in a zone of the sole plate configured for relatively high compressive loads than in a zone of the sole plate configured for relatively low compressive loads.

In one or more embodiments, the sole plate may have a compressive stiffness that is greater than that of the first foam layer and greater than that of the second foam layer.

The above features and advantages and other features and advantages of the present teachings are readily apparent from the following detailed description of the modes for carrying out the present teachings when taken in connection with the accompanying drawings.

Figure 10:
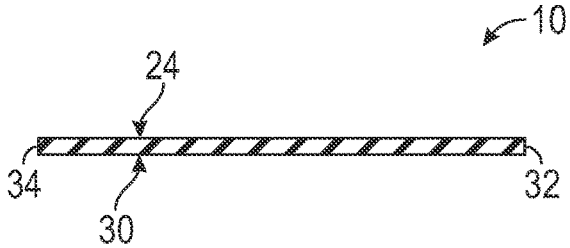
FIG. 10 is a schematic cross-sectional illustration of the sole plate of FIG. 1 taken at lines 10-10 in FIG. 1.

Referring to the drawings, wherein like reference numbers refer to like components throughout the views, FIG. 1 shows an embodiment of a sole plate 10 for an article of footwear 12, such as the article of footwear 12 of FIG. 10. More specifically, the sole plate 10 is included in a sole structure 14 of the article of footwear 12. The sole structure 14 has a midsole system 15 that includes the sole plate 10 and a resilient foam midsole 60 including first and second foam layers 60A, 60B. The foam layers 60A, 60B interact with the sole plate 10 and with one another at a strategically positioned through hole 35 in the sole plate 10 as discussed herein to provide tuned energy absorption and return that is different at the through hole than away from the through hole 35. The sole plate 10 described herein is configured to moderate bending stiffness during dorsiflexion, and direct return energy to the foot at least partially in a forward direction when dynamic compressive loading is removed following dorsiflexion during a stride. More specifically, the sole plate 10 deforms when under a dynamic load storing elastic energy, but resiliently returns to an unloaded state when the dynamic load is removed, releasing the stored elastic energy.

As used herein, the term "plate", such as in sole plate 10, refers to a member of a sole structure that has a width greater than its thickness and is generally horizontally disposed when assembled in an article of footwear that is resting on the sole structure on a level ground surface, so that its thickness is generally in the vertical direction and its width is generally in the horizontal direction. A plate need not be a single component but instead can be multiple interconnected components. Portions of a plate can be flat, and portions can have some amount of curvature and variations in thickness when molded or otherwise formed in order to provide a shaped footbed and/or increased thickness for reinforcement in desired areas.

With reference to FIG. 1, the sole plate 10 has a forefoot region 16, a midfoot region 18, and a heel region 20, and as such is referred to as a full-length sole plate 10 and is a unitary, one-piece component. Alternatively, in other embodiments within the scope of the present teachings, the sole plate 10 could include only a forefoot region 16 and midfoot region 18, or only a midfoot region 18 and heel region 20.

When a human foot 26 of a size corresponding with the sole structure 14 (see FIG. 13) is supported on the sole structure, the forefoot region 16 generally includes portions of the sole plate 10 corresponding with the toes and the joints connecting the metatarsals with the phalanges of the human foot (interchangeably referred to herein as the "metatarsal-phalangeal joints" or "MPJ" joints). The midfoot region 18 generally includes portions of the sole plate 10 corresponding with an arch area of the foot 26, including the navicular joint. The heel region 20 generally includes portions of a sole plate corresponding with rear portions of the foot 26, including the calcaneus bone. The forefoot region 16, the midfoot region 18, and the heel region 20 may also be referred to as a forefoot portion, a midfoot portion, and a heel portion, respectively, and may also be used to refer to corresponding regions of an upper 23 shown in FIG. 12 and other components of the article of footwear 12. The midfoot region 18 is disposed between the forefoot region 16 and the heel region 20 such that the forefoot region 16 is forward of (i.e., anterior to) the midfoot region 18 and the heel region is rearward of (i.e., posterior to) the midfoot region 18.

Figure 2:
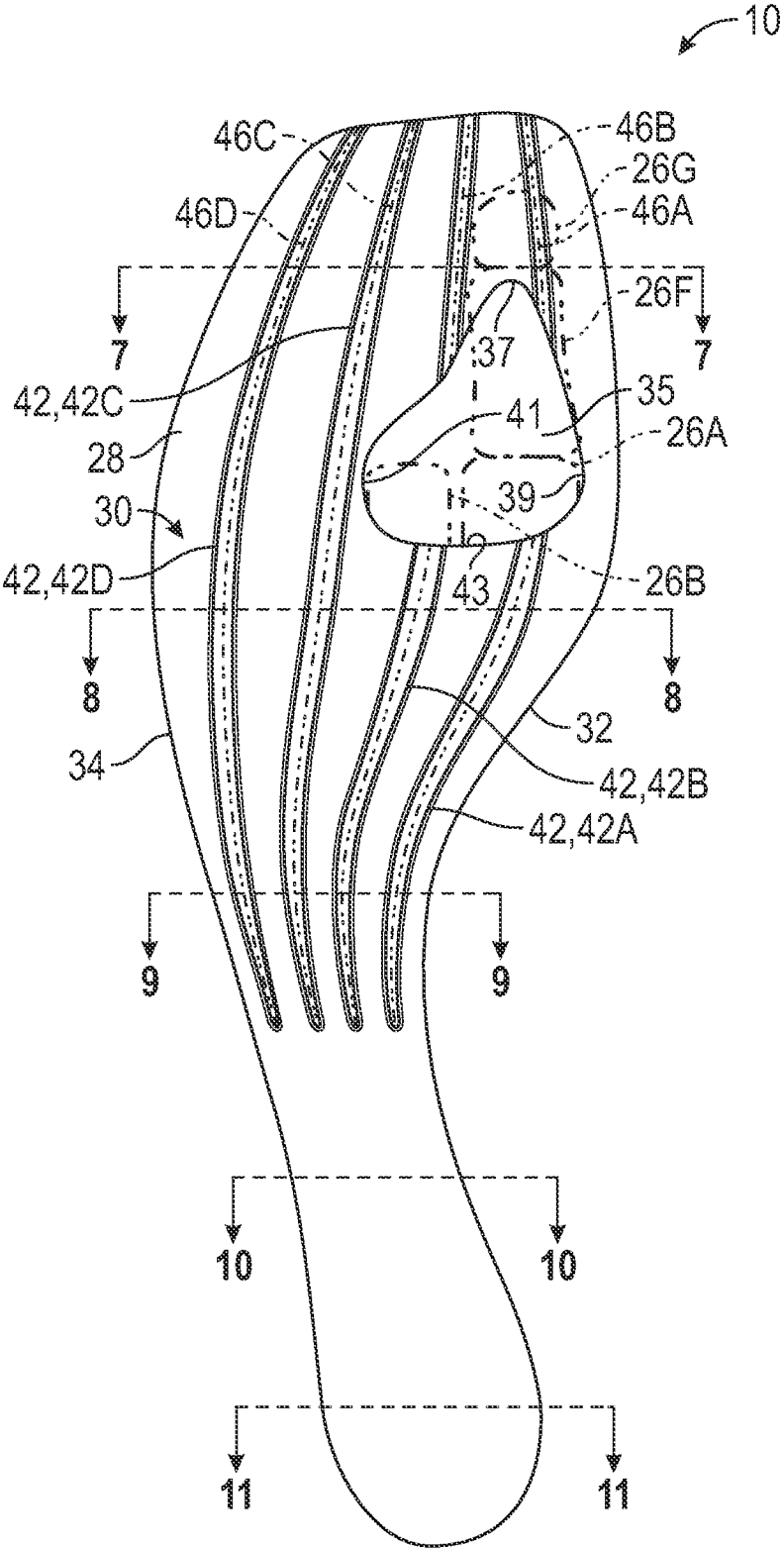
FIG. 2 is a schematic illustration in plan view of a ground-facing surface of the sole plate of FIG. 1.

The sole plate 10 has a first side 22 shown in FIG. 1, also referred to as a foot-facing side 22 that includes a foot-facing surface 24. As shown in FIG. 2, the sole plate 10 also has a second side 28 referred to as a ground-facing side 28 that includes a ground-facing surface 30. The foot-facing side 22 is closer to the foot 26 (shown in phantom in FIG. 16) than is the ground-facing side 28 when the sole plate 10 is assembled in the article of footwear 12 and worn on a foot 26. The foot-facing side 22 is above the ground-facing side 28 when the sole plate 10 is assembled in the article of footwear 12 and worn on the foot 26. The sole plate 10 also has a curved lateral edge 34 and a curved medial edge 32. The sole plate 10 is a sole plate for a right foot. It should be understood that a sole plate for a left foot is a mirror image of the sole plate 10.

The sole plate 10 defines a through hole 35 extending from the foot-facing surface 24 to the ground-facing surface 30 in the forefoot region 16. The through hole 35 is closer to a medial edge 32 of the sole plate than to a lateral edge 34 of the sole plate. More of the through hole 35 is disposed between the medial edge 32 and the longitudinal midline LM than between the lateral edge 34 and the longitudinal midline LM. Additionally, the through hole has an irregular shape that tapers in width in a forward direction. The irregular shape is defined by the continuous edge 33 of the sole plate 10 bordering and defining the through hole 35, including a medial extremity 39, a lateral extremity 41, a relatively wide rear edge 43, and a narrow, peaked forward extremity 37. The continuous edge 33 is a smooth, curved edge, without any corners or angles. The through hole 35 tapers in width from the medial extremity 39 and the lateral extremity 41 in the forward direction. The peaked forward extremity 37 is closer to the medial extremity 39 than to the lateral extremity 41, making the through hole 35 asymmetrical. Some of the bones of the foot 26 are shown in phantom in FIG. 2 overlying the sole plate 10. The metatarsal heads are partially shown in phantom including the first metatarsal head 26A, the second metatarsal head 26B, the third metatarsal head 26C, the fourth metatarsal head 26D, and the fifth metatarsal head 26E. The hallux is represented by phalanges 26F, 26G. Due to the irregular shape of the through hole 35, the through hole 35 is configured to underlie first and second metatarsal heads 26A, 26B and the hallux 26F, 26G of an average wearer having a foot size correlated with that of the sole plate 10 and the article of footwear 12, such as based on population averages.

Figure 7:
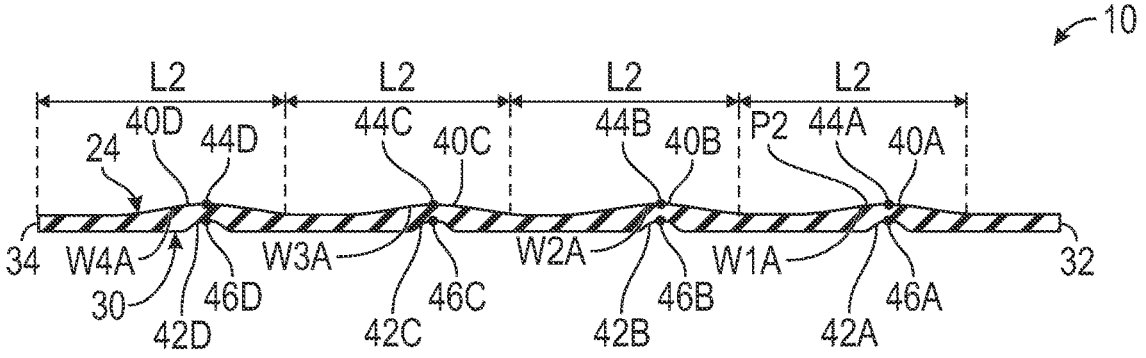
FIG. 7 is a schematic cross-sectional illustration of the sole plate of FIG. 1 taken at lines 7-7 in FIG. 1.
Figure 8:
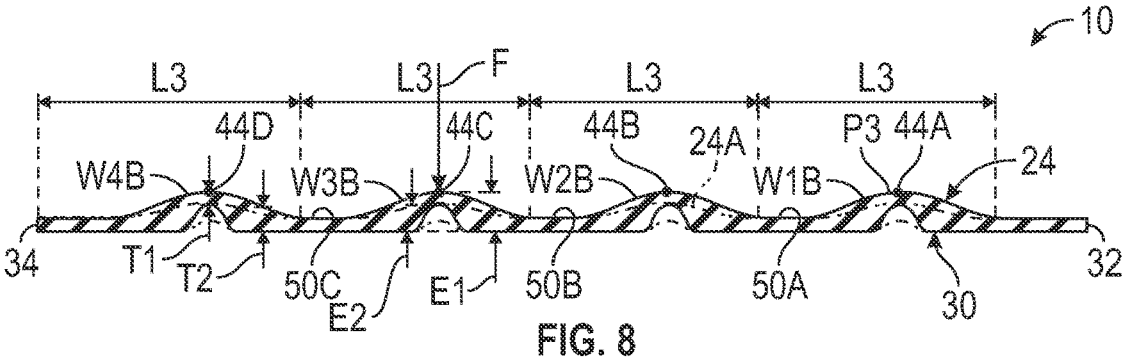
FIG. 8 is a schematic cross-sectional illustration of the sole plate of FIG. 1 taken at lines 8-8 in FIG. 1.
Figure 9:
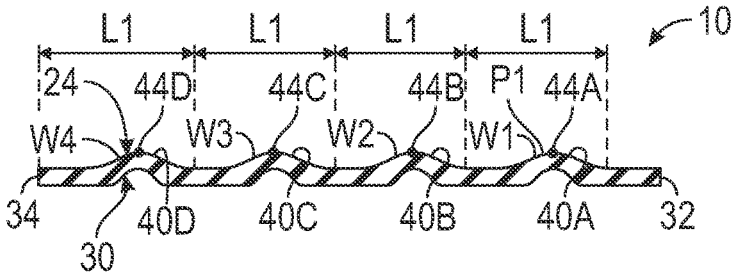
FIG. 9 is a schematic cross-sectional illustration of the sole plate of FIG. 1 taken at lines 9-9 in FIG. 1.
Figure 11:
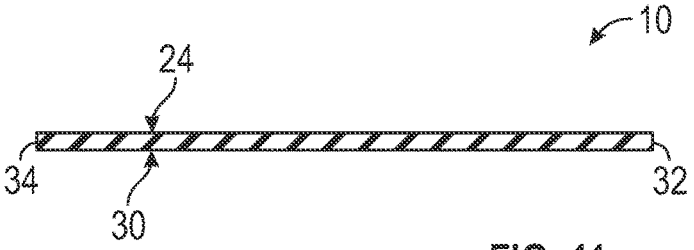
FIG. 11 is a schematic cross-sectional illustration of the sole plate of FIG. 1 taken at lines 11-11 in FIG. 1.

Referring to FIG. 1, the foot-facing surface 24 has ridges 40 extending longitudinally in the midfoot region 18 and in the forefoot region 16. The ridges 40 do not extend to the heel region 20. The foot-facing surface 24 is generally flat in the heel region 20 as best shown in FIGS. 10 and 11. The ground-facing surface 30 has grooves 42 extending longitudinally in correspondence with the ridges 40. In the embodiment shown, there are four ridges 40 and four grooves 42. More specifically, as best shown in FIGS. 7-9, there are four ridges 40A, 40B, 40C, 40D in order between the medial edge 32 and the lateral edge 34. The ridges 40A, 40B, 40C, 40D have crests 44A, 44B, 44C, 44D, respectively, that extend along the lengths of the respective ridges. A lateral-most one of the ridges 40D curves in the longitudinal direction to follow the curved lateral edge 34, and the medial-most one of the ridges 40A curves in the longitudinal direction to follow the curved medial edge 32. Stated differently, the ridge 40D curves relative to a longitudinal midline LM to generally follow the lateral edge 34, and the ridge 40A curves relative to the longitudinal midline LM to generally follow the medial edge 32. The longitudinal direction is generally a direction along a longitudinal midline LM of the sole plate 10, and may be either a forward direction (i.e., from the midfoot region 18 toward the forefoot region 16), or a rearward direction (i.e., from the forefoot region 16 toward the midfoot region 18).

Figure 3:
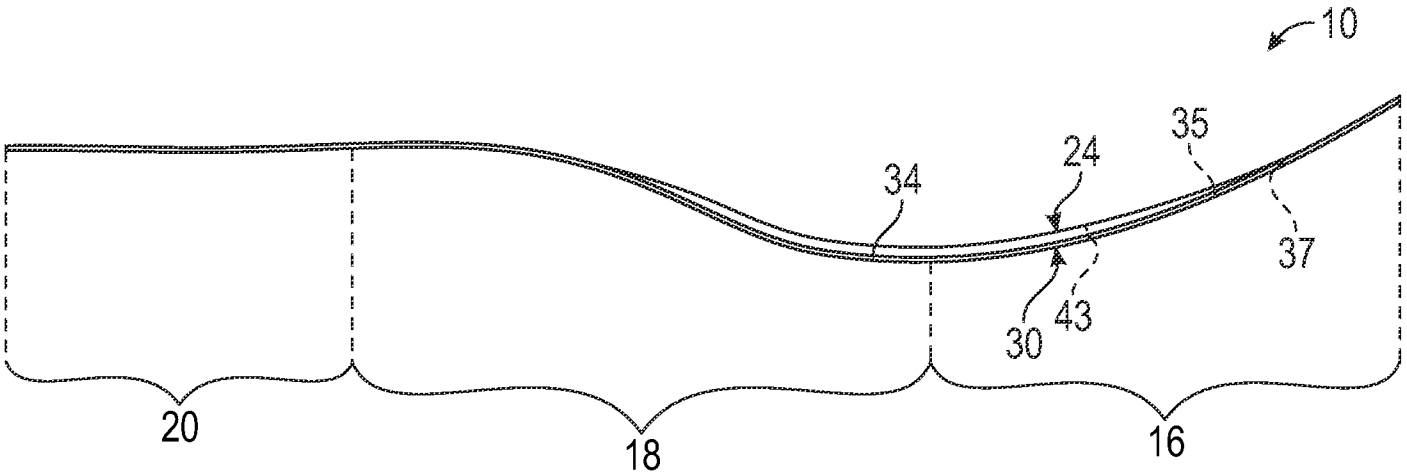
FIG. 3 is a schematic illustration in lateral side view of the sole plate of FIG. 1.
Figure 4:
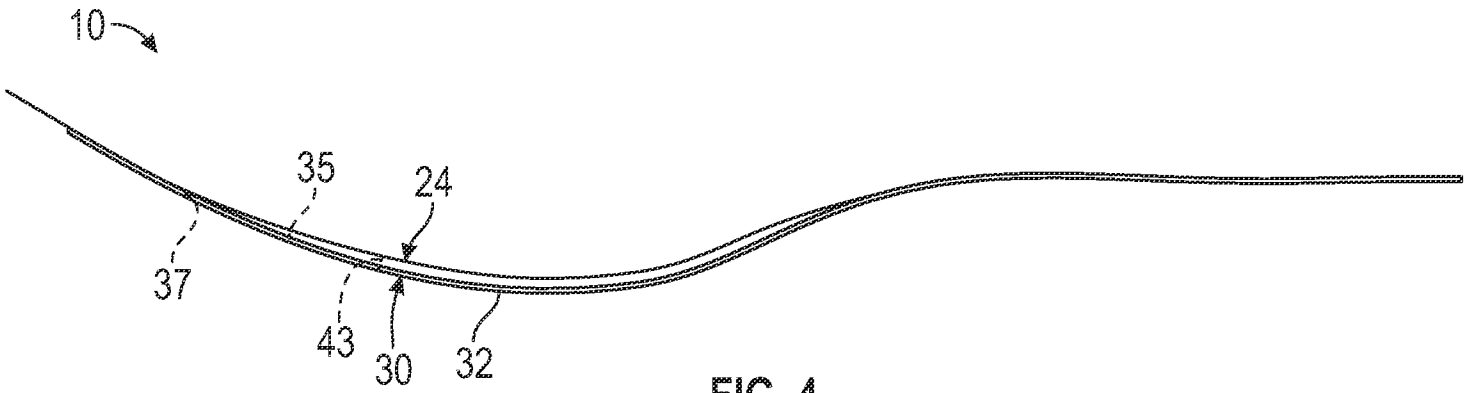
FIG. 4 is a schematic illustration in medial side view of the sole plate of FIG. 1.
Figure 5:
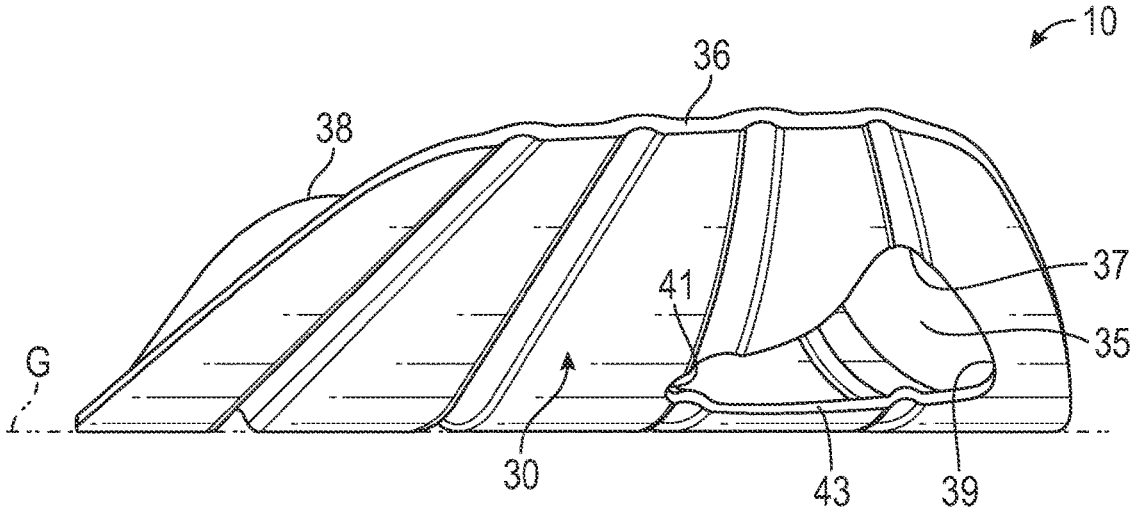
FIG. 5 is a schematic illustration in front view of the sole plate of FIG. 1.
Figure 6:
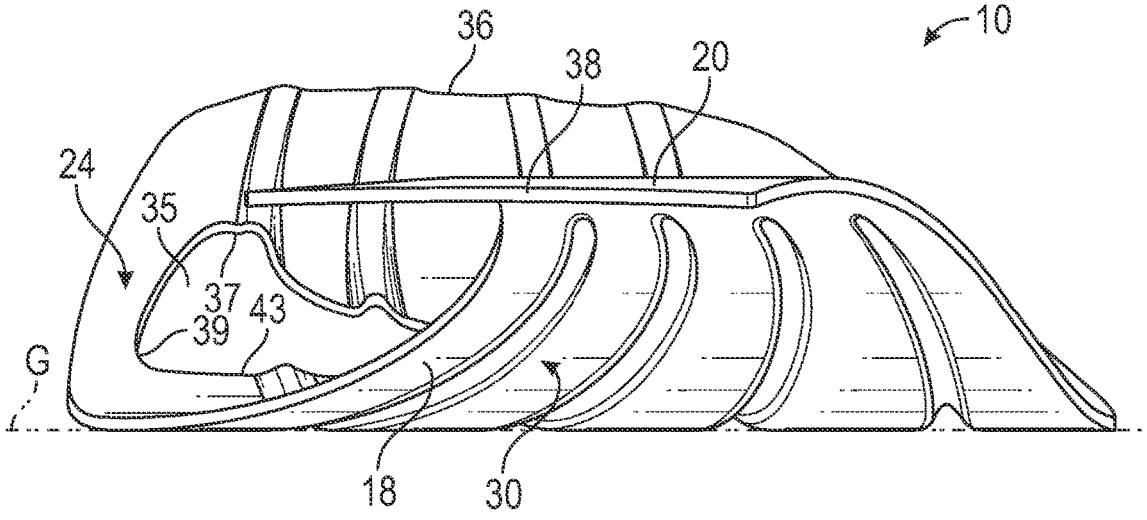
FIG. 6 is a schematic illustration in rear view of the sole plate of FIG. 1.
Figure 12:
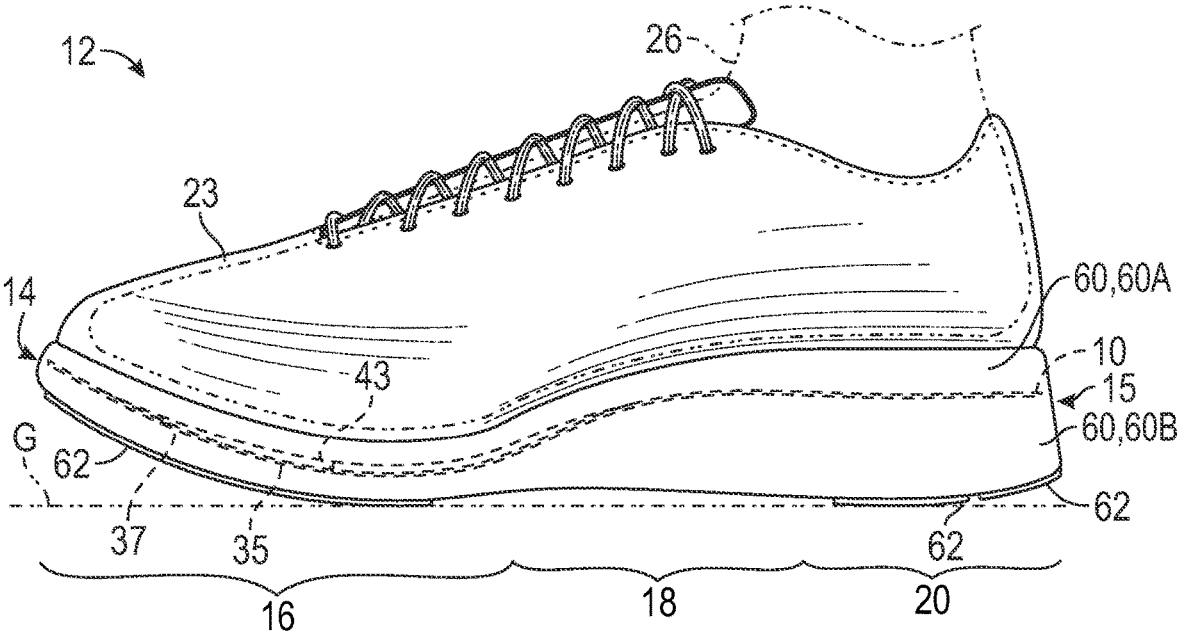
FIG. 12 is a schematic illustration in medial side view of an article of footwear having a sole structure with a midsole system that includes the sole plate of FIG. 1, with the sole plate shown in hidden lines.

With reference to FIGS. 3 and 4, the foot-facing surface 24 is concave in a longitudinal direction of the sole plate 10 in the forefoot region 16, and the ground-facing surface 30 is convex in the longitudinal direction of the sole plate 10 in the forefoot region 16. The concavity of the foot-facing surface 24 and the convexity of the ground-facing surface 30 extend into the midfoot region 18 so that the midfoot region 18 and the forefoot region 16 together establish a spoon shape. Additionally, the sole plate 10 slopes in the longitudinal direction in the midfoot region 18 from the heel region 20 to the forefoot region 16. More specifically, the midfoot region 18 slopes downward from the heel region 20 to the forefoot region 16 when the sole plate 10 is assembled in the sole structure 14 and the sole structure 14 rests on a level ground surface G as shown in FIG. 12. FIGS. 5 and 6 also illustrate the concavity of the foot-facing surface 24 and the convexity of the ground-facing surface 30 in the forefoot region 16. In FIGS. 5 and 6, the sole plate 10 is shown with the lowest point resting on a level ground surface G (i.e., prior to installation in the sole structure 14). The sole plate 10 slopes downward in the forefoot region 16 from a front edge 36. The sole plate 10 slopes down in the midfoot region 18 relative to the heel region 20 which is level with a rear edge 38. The front edge 36 is higher than the rear edge 38 when in this position.

As used herein, a transverse cross-section of the sole plate 10 through the ridges 40 is a cross-section perpendicular to the longitudinal midline LM, such as the cross-sections of FIGS. 7-11. As best shown in FIGS. 7-9, at any particular transverse cross-section of the sole plate 10 through the ridges 40A, 40B, 40C, 40D, the crests 44A, 44B, 44C, 44D are equally spaced apart from one another. Stated differently, all adjacent crests 44A, 44B, 44C, 44D are equally-spaced. However, because the distance between the lateral edge 34 and the medial edge 32 varies along the length of the sole plate 10 (i.e., the sole plate 10 has different widths at different transverse cross-sections), the crests 44A, 44B, 44C, 44D extend non-parallel with one another in the longitudinal direction of the sole plate 10.

With reference to FIG. 2, there are four grooves 42A, 42B, 42C, 42D on the ground-facing surface 30, in order, between the medial edge 32 and the lateral edge 34. As is apparent in FIG. 2, the grooves 42A, 42B, 42C, 42D do not extend to the heel region 20, and the ground-facing surface 30 is generally flat in the heel region 20. The ridges 40 and the grooves 42 extend only in the midfoot region 18 and the forefoot region 16. The grooves 42A, 42B, 42C, 42D have crests 46A, 46B, 46C, 46D, respectively, that extend along the lengths of the respective grooves. A lateral-most one of the grooves 42D curves in the longitudinal direction to follow the curved lateral edge 34, and the medial-most one of the grooves 42A curves in the longitudinal direction to follow the curved medial edge 32. Stated differently, the groove 42D curves relative to the longitudinal midline LM to generally follow the lateral edge 34, and the groove 42A curves relative to the longitudinal midline LM to follow the medial edge 32. Like crests 44A, 44B, 44C, 44D, at any transverse cross-section of the sole plate 10 through the ridges 40A, 40B, 40C, 40D, the crests 46A, 46B, 46C, 46D are equally spaced apart from one another (i.e., all adjacent crests 46A, 46B, 46C, 46D are equally-spaced) and the crests 46A, 46B, 46C, 46D extend non-parallel with one another in the longitudinal direction of the sole plate 10.

The crests 46A, 46B, 46C, 46D of the grooves 42A, 42B, 42C, 42D are aligned with crests 44A, 44B, 44C, 44D of the ridges 40A, 40B, 40C, 40D. As used herein, the crests 44A, 44B, 44C, 44D are aligned with the crests 46A, 46B, 46C, 46D because the crests directly underlie the crests 44A, 44B, 44C, 44D along the length of the ridge 40A, 40B, 40C, 40D so that a line connecting crests of a corresponding ridge and groove (e.g., a line connecting crest 44A and crest 46A) is perpendicular to a line along the flat portions of the ground-facing surface 30 at the transverse cross-section. As is apparent in FIGS. 1-2, and 5-9, the ground-facing surface 30 of the sole plate 10 is flat between the grooves 42 at any transverse cross-section.

Due to the ridges 40 and the grooves 42, the sole plate 10 has an undulating profile at any transverse cross-section of the sole plate 10 through the ridges 40. For example, the transverse cross-section of FIG. 9 is a first transverse cross-section of the sole plate 10 in the midfoot region 18. The foot-facing surface 24 has an undulating profile P1 of the sole plate at the first transverse cross-section. The undulating profile P1 includes a first set of multiple waves W1, W2, W3, W4 having crests 44A, 44B, 44C, 44D at the ridges 40A, 40B, 40C, 40D, and having troughs 50A, 50B, 50C between respective adjacent ones of the ridges. Each of the waves W1, W2, W3, W4 is of an equal wavelength first L1.

The transverse cross-section at FIG. 7 is a second transverse cross-section of the sole plate 10 through the ridge 40 in the forefoot region 16. The undulating profile P2 of the sole plate 10 at the second transverse cross-section includes a second set of multiple waves W1A, W2A, W3A, W4A having crests 44A, 44B, 44C, 44D at the ridges 40A, 40B, 40C, 40D, and having the troughs 50A, 50B, 50C between respective adjacent ones of the ridges. Each of the waves W1A, W2A, W3A, W4A is of an equal second wavelength L2. The second wavelength L2 is greater than the first wavelength L1 due to the greater width of the sole plate 10 (from the medial edge 32 to the lateral edge 34) at the second transverse cross-section.

A third transverse cross-section of the sole plate 10 across the ridges 40 is shown in FIG. 8 and is positioned longitudinally between the first and second cross-sections of FIGS. 9 and 7. The undulating profile P3 of the sole plate 10 at the third transverse cross-section includes a third set of multiple waves W1B, W2B, W3B, W4B having the crests 44A, 44B, 44C, 44D at the ridges 40A, 40B, 40C, 40D, and having the troughs 50A, 50B, 50C between respective adjacent ones of the ridges. Each of the waves W1B, W2B, W3B, W4B is of an equal third wavelength L3. The third wavelength L3 is greater than the first wavelength L1 and the second wavelength L2 due to the width of the sole plate 10 at the third transverse cross-section being greater than that at the first transverse cross-section and greater than that at the second transverse cross-section. Generally, increasing the number of ridges 40 over a given width (i.e., decreasing the wavelength) increases the bending stiffness in the longitudinal direction of the sole plate 10. The sole plate 10 is wider in the forefoot region 16 at the third transverse cross-section of FIG. 8 than in the midfoot region 18 at the first transverse cross-section of FIG. 9. Because the ridges 40 are nonparallel and the wavelengths of the waves at a given transverse cross-section are equal, the sole plate 10 has the same number of ridges (four) over the forefoot region 16 and midfoot region 18.

In addition to the number of ridges 40, the thickness of the sole plate 10 and the amplitude of the crests 44A, 44B, 44C, 44D affect the bending stiffness as well as the energy return of the sole plate 10. When the crests 44A, 44B, 44C, 44D are referred to generally herein, the reference numeral 44 may be used. The ridges 40 and the grooves 42 are configured such that a thickness of the sole plate 10 from the foot-facing surface 24 to the ground-facing surface 30 varies at a transverse cross-section of the sole plate 10 through the ridges 40 and varies along a length of at least one of the ridges 40. For example, as shown at the transverse cross-section in FIG. 8, the thickness T1 of the sole plate 10 at the crests 44 of the ridges 40 (as shown at crest 44D) is less than the thickness T2 of the sole plate 10 at a location between the crests of the ridges and the troughs. The sole plate 10 will thus tend to elastically deform under a compressive load applied to the foot-facing surface 24 beginning at the crests 44. For example, the sole plate 10 may be a resilient material such that the foot-facing surface 24 including the crests 44 of the ridges 40 decreases in elevation under a dynamic compressive load from the steady state elevation shown with solid lines in FIG. 8 to a loaded elevation 24A shown in phantom in FIG. 8, and returns to the steady state elevation upon removal of the dynamic compressive load. At the crest 44C, for example, the elevation decreases from elevation E1 to elevation E2. For example, the sole plate 10 may be a fiber strand-lain composite, a carbon-fiber composite, a thermoplastic elastomer, a glass-reinforced nylon, wood, steel, or combinations thereof.

The ability of and the degree to which the sole plate 10 elastically deforms is also tuned by varying the thickness of the sole plate 10 along the length of the ridges 40, and by varying the amplitude of the crests 44 along the length of the ridges 40. A comparison of the transverse cross-sections of FIGS. 7-11 shows that the sole plate 10 is thinnest (i.e., has the least thickness) at the ridges 40 where the amplitude of the crests 44 is the highest (e.g., in FIG. 8), and the thickens gradually at the crests 44 as the amplitude decreases, as can be seen in FIGS. 7 and 9.

The ability of and the degree to which the sole plate 10 elastically deforms is tuned by varying the thickness of the sole plate 10 along the length of the ridges 40, and by varying the amplitude of the crests 44 along the length of the ridges 40. When the crests 46A, 46B, 46C, 46D are referred to generally herein, the reference numeral 46 may be used. The amplitude of the crests 46 is greater in zones of the sole plate 10 configured for relatively high compressive loads than in zones of the sole plate 10 configured for relatively low compressive loads. For example, referring to FIG. 1, at least some of the crests 46 may have an amplitude that is greater in a rearward portion 16A of the forefoot region 16 (e.g., including at the transverse cross-section of FIG. 8) than in a forward portion 16B of the forefoot region (e.g., including at the transverse cross-section of FIG. 7), and than in the midfoot region (e.g., including at the transverse cross-section of FIG. 9). The greater amplitude of the crests 46 enables greater energy absorption under sufficient dynamic loading as more elastic deformation can occur with a greater possible change in height of the crests 46 between a steady state elevation and a loaded elevation. In the embodiment of the sole plate 10, the amplitude of the crests 44 at any given transverse cross-section is uniform. Stated differently, each of the crests 44A, 44B, 44C, 44D has the same amplitude at the cross-section of FIG. 7, has the same amplitude at the cross-section of FIG. 8 (although different from that at FIG. 7), and has the same amplitude at the cross-section of FIG. 9 (although different from that at FIGS. 7 and 8).

Referring to FIG. 12, the sole structure 14 includes a resilient foam midsole 60. The sole structure 14 also includes discrete outsole elements 62, or alternatively, could include a unitary outsole. The midsole 60 includes a first foam layer 60A secured to the foot-facing surface 24, and a second foam layer 60B secured to the ground-facing surface 30. The first and second foam layers 60A, 60B are separate components having different compressive stiffnesses. The first foam layer 60A may be more or less stiff than the second foam layer 60B. The first foam layer 60A and the second foam layer 60B may be the same material composition, with different densities to provide the different compressive stiffnesses, or may be different materials.

Figure 18:
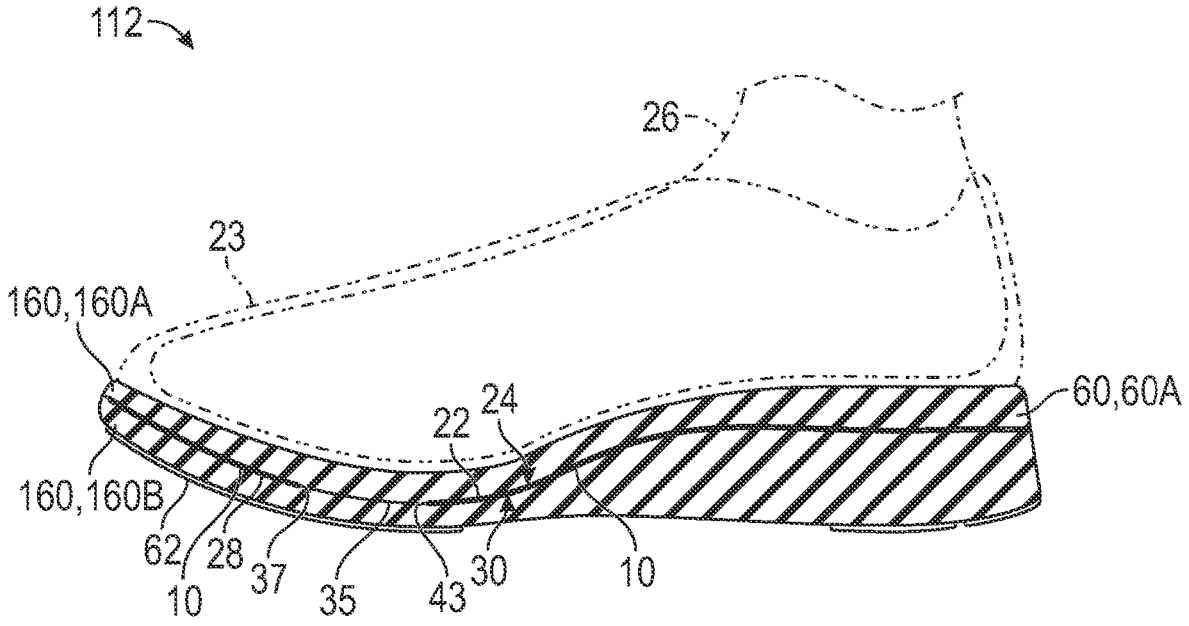
FIG. 18 is a schematic illustration in cross-sectional view of an alternative of footwear having an alternative embodiment of a midsole system with the sole plate of FIG. 1.

Alternatively, as shown in FIG. 18, an alternative article of footwear 112 has a midsole 160 that includes first and second foam layers 160A, 160B that are portions of a single component (i.e., a single, unitary, one-piece resilient foam midsole 160). The first and second resilient foam midsole layers 160A, 160B are an upper portion and a lower portion of a single resilient foam midsole 160 surrounding the sole plate 10, and in one embodiment, may be formed by injecting foam around the sole plate. The first and second foam layers 160A, 160B are the same material and have the same compressive stiffness.

Figure 15:
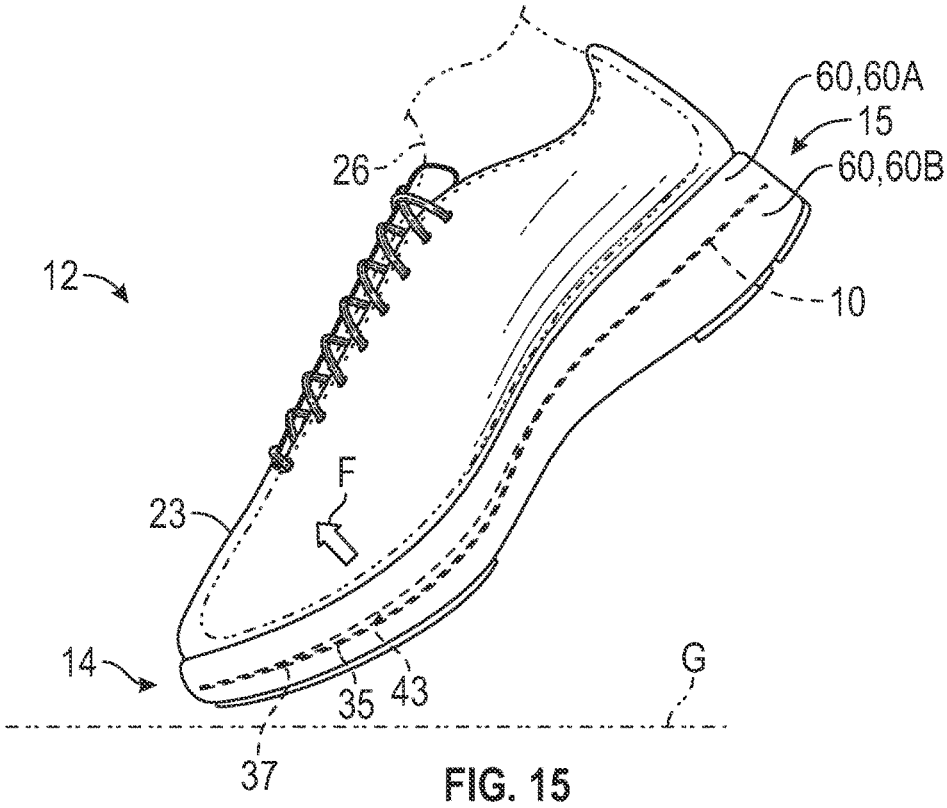
FIG. 15 is a schematic illustration in medial side view of the article of footwear of FIG. 12, in a third stage of motion.
Figure 17:
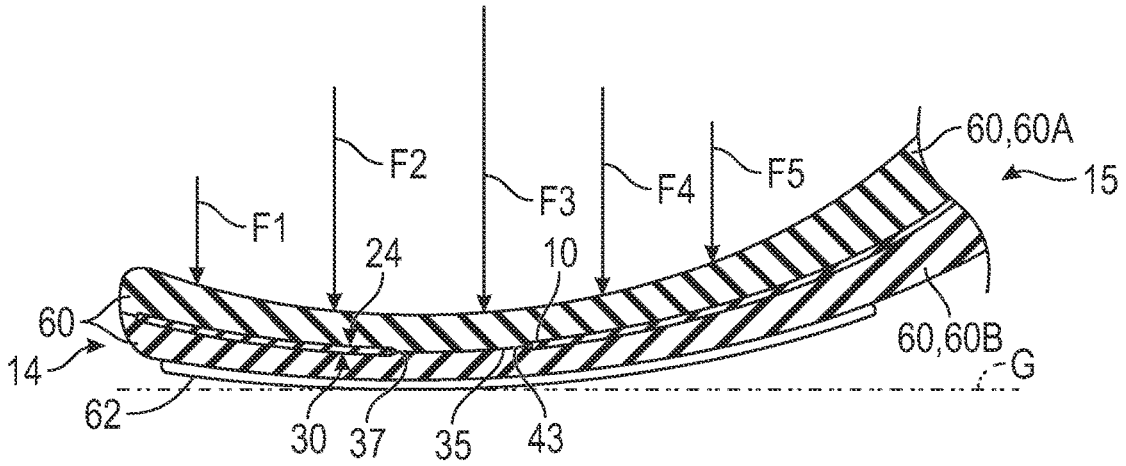
FIG. 17 is a schematic fragmentary cross-sectional illustration of a forefoot portion of the article of footwear of FIG. 16 when in the second stage of motion of FIG. 14.

The first foam layer 160A overlays the through hole 35. The second foam layer 160B underlies the through hole 35. The first foam layer 60A and the second foam layer 60B resiliently deform under a dynamic compressive load, as shown for example in FIG. 17, and return energy upon removal of the dynamic compressive load, returning to their steady state shapes as shown in FIG. 15. The first foam layer 60A is compressed against the second foam layer 60B at the through hole 35 under the dynamic compressive load. For example, as shown in FIG. 17, a bottom surface 51 of the first foam layer 60A contacts a top surface 53 of the second foam layer 60B at the through hole 35 such that the first and second foam layers 60A, 60B are compressed against each other at the through hole 35. Away from the through hole 35 (i.e., where the lower surface 51 of the first resilient foam layer 60A is secured to the foot-facing surface 24, and where the upper surface 53 of the second foam layer 60B is secured to the ground-facing surface 30), the first foam layer 60A and the second foam layer 60B are compressed against the sole plate 10 under the dynamic compressive load. The resilient deformation and the energy absorption of each of the first and second foam layers 60A, 60B is thus different at the through hole 35 than away from the through hole 35. For example, greater deformation of the foam layers 60A, 60B may be experienced at the through hole 35 than away from the through hole 35, as the foam layers may have less compressive stiffness than the sole plate. A softer cushioning feel may be experienced by a foot supported on the sole structure 14 at the through hole 35 (i.e., above the through hole) than away from the through hole. The first and second metatarsal heads 26A, 26B and the phalanges 26F, 26G of the hallux may thus experience greater cushioning.

In one or more embodiments, the sole plate 10 has a greater compressive stiffness than the first foam layer 60A and has a greater compressive stiffness than the second foam layer 60B. For example, in one or more embodiments, the sole plate 10 is one of a fiber strand-lain composite, a carbon-fiber composite, a thermoplastic elastomer, a glass-reinforced nylon, wood, or steel. Accordingly, the midsole system 15 is tuned to provide different energy return at the through hole 35 than away from the through hole 35. Dynamic compressive loading on the first resilient foam layer 60A is reacted with greater energy absorption at the through hole 35 where the first and second foam layers 60A. 60B interface with one another than away from the through hole 35 where the first and second resilient foam layers 60A, 60B react against and interface with the sole plate 10.

As indicated in FIG. 17, the foam midsole 60 compresses between the foot 26 and the ground G under a dynamic compressive load and reacts against both the foot-facing surface 24 and the ground-facing surface 30 of the stiffer sole plate 10. The first foam layer 60A and the second foam layer 60B resiliently deform under the dynamic compressive load. The dynamic compressive load is illustrated by distributed loads F1, F2, F3, F4, F5 having various magnitudes represented by the length of the arrows. The first and second foam layers 60A, 60B return energy upon removal of the dynamic compressive load. Under dynamic loading, the first foam layer 60A is compressed against the foot-facing surface 24, and the second foam layer is compressed against the ground-facing surface 30.

Figure 13:
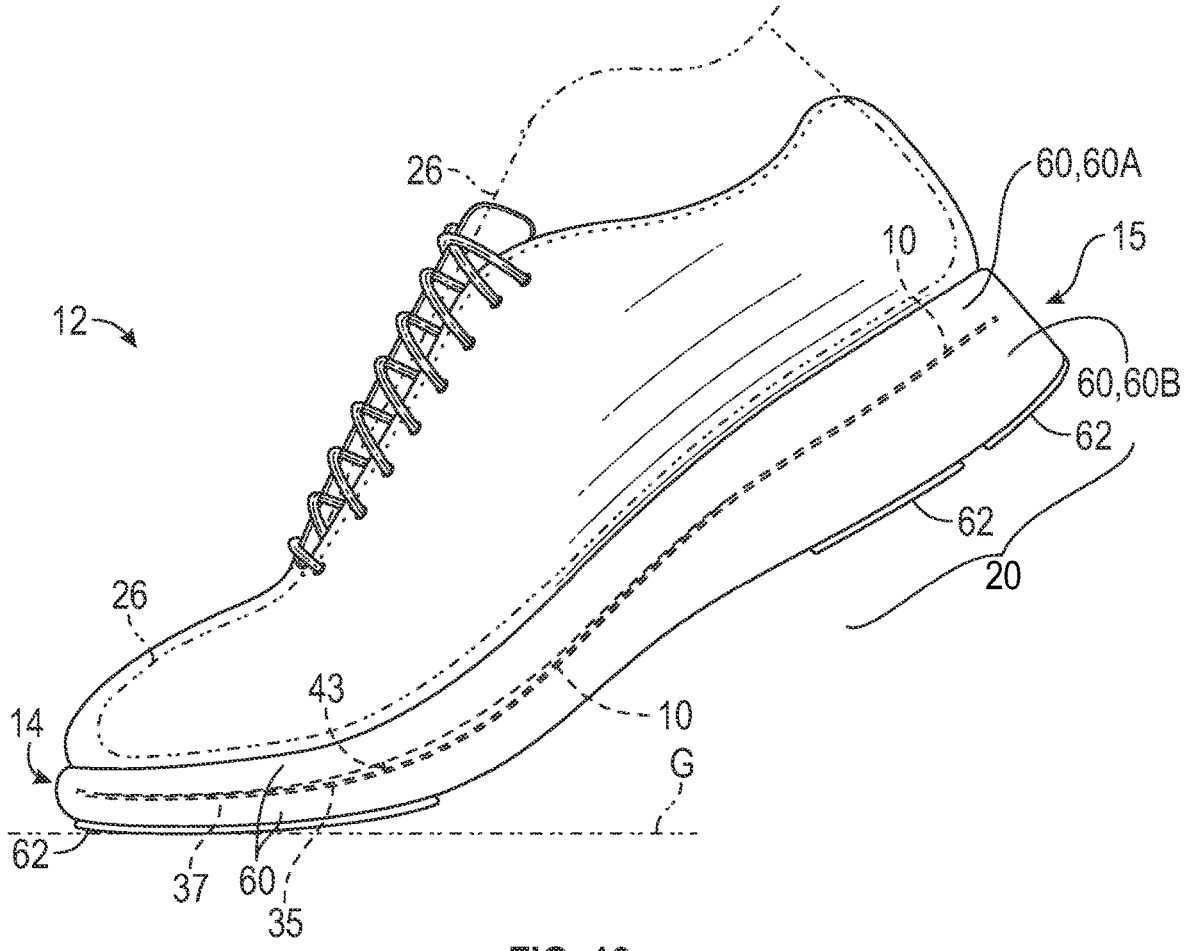
FIG. 13 is a schematic illustration in medial side view of the article of footwear of FIG. 12, in a first stage of motion.
Figure 14:
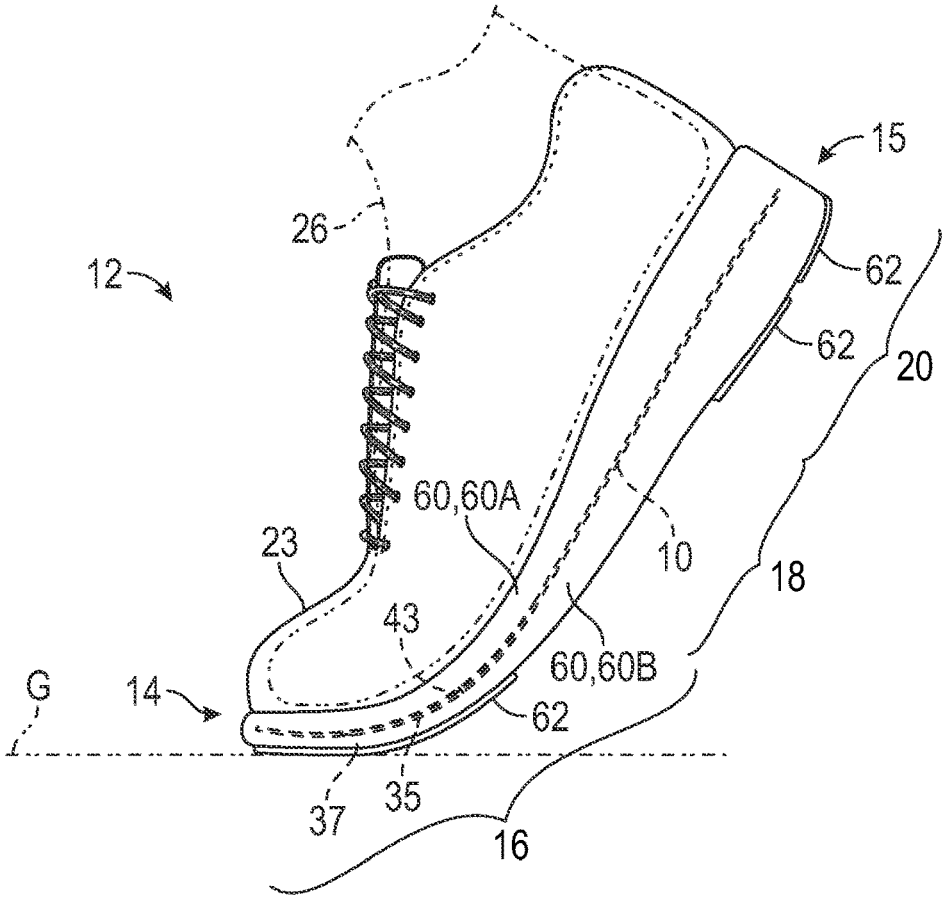
FIG. 14 is a schematic illustration in medial side view of the article of footwear of FIG. 12, in a second stage of motion.

FIG. 12 shows the article of footwear in a resting position, under steady state loading by the foot 26. FIG. 12 may also represent an interim position of the article of footwear 12 during a stride in which the sole structure 14 is flat on the ground G. FIGS. 13-15 show the article of footwear 12 in progressive first, second, and third stages of motion during the stride. The first stage of motion show in FIG. 13 is the beginning of the stride, with the heel region 20 of the sole structure 14 and at least part of the midfoot region 18 lifted from the ground G and the forefoot region 16 in contact with the ground G. The second stage of motion in FIG. 14 shows further lifting of the region portion 18 of the sole structure 14 away from the ground surface G and the forefoot region 16 in contact with the ground G. Finally, FIG. 15 shows the article of footwear 12 completely lifted away from the ground G, as may occur during running. During the stride, the sole plate 10 bends along its length (e.g., along its longitudinal midline LM shown in FIG. 1). Progressive bending occurs in the forefoot region 16, generally under the metatarsal-phalangeal joints of the foot 26, when the foot 26 is dorsiflexed and increased loading is placed in the forefoot region 16 as the wearer's weight shifts to the forefoot. The hole 35 reduces the longitudinal bending stiffness of the sole plate 10 in the forefoot region 16 in comparison to a sole plate of the same thickness but without the hole.

Figure 16:
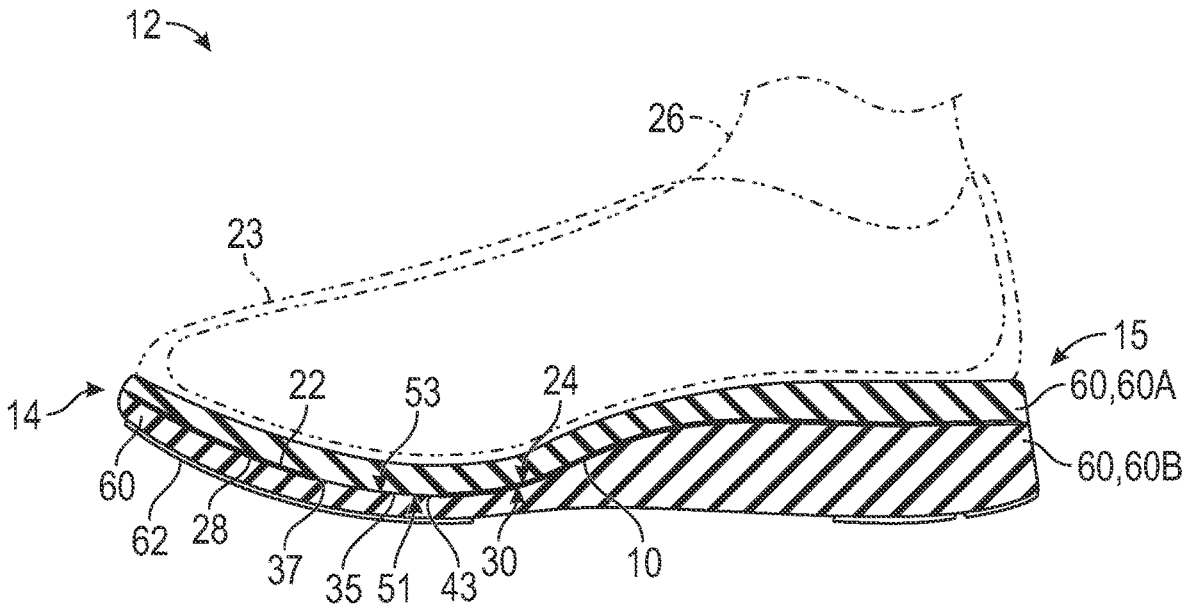
FIG. 16 is a schematic illustration in cross-sectional view of the article of footwear of FIG. 12 taken at lines 16-16 in FIG. 12.

The spoon shape of the sole plate 10, best shown in FIG. 16, including the concave foot-facing surface 24 and convex ground-facing surface 30 in the forefoot region 16 helps to encourage forward rolling of the foot 26. When the foot 26 lifts the sole structure 14 away from the ground Gin FIG. 15, the compressive forces in the sole plate 10 above a neutral axis of the sole plate 10 to the foot-facing surface 24, and tensile forces below the neutral axis to the ground-facing surface 30 are relieved, returning the sole plate 10 to its unloaded orientation shown in FIG. 15, which is the same as in FIG. 12 except lifted from the ground. The internal compressive and tensile forces in the sole plate 10 due to the wearer bending the sole plate 10 are released as the sole plate 10 unbends creates a net force F at least partially in the forward direction.

Accordingly, as discussed herein the sole plate 10 is tuned by varying its thickness, the amplitude of crests of ridges, and by the spoon shape, all of which contribute to the energy absorption during dynamic compression and longitudinal bending, and subsequent energy return during forward strides.

The following Clauses provide example configurations of a sole structure for an article of footwear disclosed herein.

Clause 1: A sole structure for an article of footwear comprising: a midsole system including: a sole plate having a forefoot region and a midfoot region; wherein the sole plate has a foot-facing surface and a ground-facing surface opposite to the foot-facing surface; wherein the sole plate defines a through hole extending from the foot-facing surface to the ground-facing surface in the forefoot region; and wherein the through hole is closer to a medial edge of the sole plate than to a lateral edge of the sole plate.

Clause 2: The sole structure of Clause 1, wherein the through hole has an irregular shape that tapers in width in a forward direction.

Clause 3: The sole structure of any of Clauses 1-2, wherein the through hole is configured to underlie first and second metatarsal heads and a hallux of a wearer.

Clause 4: The sole structure of any of Clauses 1-3, wherein the midsole system further includes: a first foam layer secured to the foot-facing surface and overlaying the through hole; a second foam layer secured to the ground-facing surface and underlying the through hole; wherein the first foam layer and the second foam layer resiliently deform under a dynamic compressive load and return energy upon removal of the dynamic compressive load; wherein the first foam layer is compressed against the second foam layer at the through hole under the dynamic compressive load; and wherein the first foam layer and the second foam layer are compressed against the sole plate away from the through hole under the dynamic compressive load.

Clause 5: The sole structure of Clause 4, wherein the sole plate has a compressive stiffness that is greater than that of the first foam layer and greater than that of the second foam layer.

Clause 6: The sole structure of Clause 5, wherein the sole plate is one of a fiber strand-lain composite, a carbon-fiber composite, a thermoplastic elastomer, a glass-reinforced nylon, wood, or steel.

Clause 7: The sole structure of any of Clauses 1-6, wherein: the foot-facing surface is concave in a longitudinal direction of the sole plate in the forefoot region; and the ground-facing surface is convex in the longitudinal direction of the sole plate in the forefoot region.

Clause 8: The sole structure of Clause 7, wherein: the sole plate further includes a heel region; and the sole plate slopes in the longitudinal direction in the midfoot region from the heel region to the forefoot region.

Clause 9: The sole structure of any of Clauses 1-8, wherein: the foot-facing surface has ridges extending longitudinally in the midfoot region and in the forefoot region; the ground-facing surface has grooves extending longitudinally in correspondence with the ridges; and the ridges and the grooves are configured such that a thickness of the sole plate from the foot-facing surface to the ground-facing surface varies at a transverse cross-section of the sole plate through the ridges, or varies along a length of at least one of the ridges, or varies at both the transverse cross-section of the sole plate through the ridges and along the length of the at least one of the ridges.

Clause 10: The sole structure of Clause 9, wherein: the ridges have crests at least some of which extend non-parallel with one another in a longitudinal direction of the sole plate; and the grooves have crests at least some of which extend non-parallel with one another in the longitudinal direction;

Clause 11: The sole structure of Clause 10, wherein: a lateral-most one of the ridges curves in the longitudinal direction to follow a curved lateral edge of the sole plate; and a medial-most one of the ridges curves in the longitudinal direction to follow a curved medial edge of the sole plate.

Clause 12: The sole structure of Clause 9, wherein the ridges have crests at least some of which vary in amplitude in a longitudinal direction of the sole plate such that the amplitude is greater in a zone of the sole plate configured for relatively high compressive loads than in a zone of the sole plate configured for relatively low compressive loads.

Clause 13: The sole structure of Clause 12, wherein at least some of the crests have an amplitude that is greater in a rearward portion of the forefoot region than in a forward portion of the forefoot region and than in the midfoot region.

Clause 14: The sole structure of Clause 9, wherein the ridges have crests, and the sole plate is a resilient material such that the crests of the ridges decrease in elevation from a steady state elevation to a loaded elevation under a dynamic compressive load and return to the steady state elevation upon removal of the dynamic compressive load.

Clause 15: The sole structure of Clause 9, wherein: the foot-facing surface has an undulating profile at the transverse cross-section that includes multiple waves that have crests at the ridges and that have troughs between respective adjacent ones of the ridges; the crests at the ridges are aligned with crests of the grooves; and the ground-facing surface is flat between the grooves at the transverse cross-section.

Clause 16: The sole structure of Clause 15, wherein: the thickness of the sole plate at the transverse cross-section is less at the crests of the ridges than between the crests of the ridges and the troughs; and the sole plate further includes a heel region, and is a unitary, one-piece component.

Clause 17: A sole structure for an article of footwear comprising: a midsole system including: a sole plate having a forefoot region and a midfoot region; wherein the sole plate has a foot-facing surface and a ground-facing surface opposite to the foot-facing surface, the foot-facing surface is concave in a longitudinal direction of the sole plate in the forefoot region, and the ground-facing surface is convex in the longitudinal direction of the sole plate in the forefoot region; wherein the sole plate defines a through hole extending from the foot-facing surface to the ground-facing surface in the forefoot region; wherein the through hole has an irregular shape that tapers in width in a forward direction and is closer to a medial edge of the sole plate than to a lateral edge of the sole plate; a first foam layer secured to the foot-facing surface and overlaying the through hole; a second foam layer secured to the ground-facing surface and underlying the through hole; wherein the first foam layer and the second foam layer resiliently deform under a dynamic compressive load, and return energy upon removal of the dynamic compressive load; wherein the first foam layer is compressed against the second foam layer at the through hole during dynamic compressive loading; and wherein the first foam layer and the second foam layer are compressed against the sole plate away from the through hole.

Clause 18: The sole structure of Clause 17, wherein: the foot-facing surface has ridges extending longitudinally in the midfoot region and in the forefoot region; the ground-facing surface has grooves extending longitudinally in correspondence with the ridges; the ground-facing surface is flat between the grooves at a transverse cross-section of the sole plate through the ridges; and the ridges and the grooves are configured such that a thickness of the sole plate from the foot-facing surface to the ground-facing surface varies at the transverse cross-section of the sole plate, or varies along a length of at least one of the ridges, or varies at both the transverse cross-section of the sole plate and along the length of the at least one of the ridges.

Clause 19: The sole structure of Clause 18, wherein the ridges have crests at least some of which vary in amplitude in the longitudinal direction of the sole plate such that the amplitude is greater in a zone of the sole plate configured for relatively high compressive loads than in a zone of the sole plate configured for relatively low compressive loads.

Clause 20: The sole structure of any of Clauses 17-19, wherein the sole plate has a compressive stiffness that is greater than that of the first foam layer and greater than that of the second foam layer.

To assist and clarify the subsequent description of various embodiments, various terms are defined herein. Unless otherwise indicated, the following definitions apply throughout this specification (including the claims).

"A", "an", "the", "at least one", and "one or more" are used interchangeably to indicate that at least one of the items is present. A plurality of such items may be present unless the context clearly indicates otherwise. As used herein, "at least some" of an item means at least two of the items. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal", as used throughout this detailed description and in the claims, refers to a direction extending a length of a component. For example, a longitudinal direction of a shoe extends between a forefoot region and a heel region of the shoe. The term "forward" is used to refer to the general direction from a heel region toward a forefoot region, and the term "rearward" is used to refer to the opposite direction, i.e., the direction from the forefoot region toward the heel region. In some cases, a component may be identified with a longitudinal axis as well as a forward and rearward longitudinal direction along that axis.

The term "vertical", as used throughout this detailed description and in the claims, refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, and may generally point towards the sole structure, or towards the outermost components of the sole structure.

The "interior" of an article of footwear, such as a shoe, refers to portions at the space that is occupied by a wearer's foot when the shoe is worn. The "inner side" of a component refers to the side or surface of the component that is (or will be) oriented toward the interior of the shoe in an assembled shoe. The "outer side" or "exterior" of a component refers to the side or surface of the component that is (or will be) oriented away from the interior of the shoe in an assembled shoe. In some cases, the inner side of a component may have other components between that inner side and the interior in the assembled shoe. Similarly, an outer side of a component may have other components between that outer side and the space external to the assembled shoe. Further, the terms "inward" and "inwardly" shall refer to the direction toward the interior of the component or article of footwear, such as a shoe, and the terms "outward" and "outwardly" shall refer to the direction toward the exterior of the component or article of footwear, such as the shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or is further from a foot when the foot is inserted in the article as it is worn by a user. Thus, the terms proximal and distal may be understood to provide generally opposing terms to describe the relative spatial position of a footwear layer.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:
a midsole system including:
a sole plate;
wherein;
the sole plate has a foot-facing surface and a ground-facing surface opposite to the foot-facing surface;
the foot-facing surface has ridges extending longitudinally along the sole plate in a forefoot region and in a midfoot region of the sole plate, each of the ridges having an anterior end in the forefoot region and a posterior end in the midfoot region;
the ground-facing surface has grooves extending longitudinally in correspondence with the ridges; and
the sole plate defines a through hole extending from the foot-facing surface to the ground-facing surface and through one of the ridges.

2. The sole structure of claim 1, wherein the anterior end of each of the ridges is at a front edge of the sole plate.

3. The sole structure of claim 1, wherein the sole plate further includes a heel region.

4. The sole structure of claim 1, wherein a lateral-most one of the ridges curves in a longitudinal direction of the sole plate to follow a curved lateral edge of the sole plate.

5. The sole structure of claim 1, wherein a medial-most one of the ridges curves in a longitudinal direction of the sole plate to follow a curved medial edge of the sole plate.

6. The sole structure of claim 1, wherein:
the ridges include a first ridge, a second ridge, a third ridge, and a fourth ridge arranged in order from a medial side of the sole plate to a lateral side of the sole plate; and
the one of the ridges through which the through hole extends is the first ridge, and the through hole further extends through the second ridge.

7. The sole structure of claim 6, wherein the through hole further extends through the third ridge.

8. The sole structure of claim 6, wherein the through hole does not extend through the fourth ridge.

9. The sole structure of claim 6, wherein the ridges include only the first ridge, the second ridge, the third ridge, and the fourth ridge.

10. The sole structure of claim 1, wherein the ridges have crests at least some of which extend non-parallel with one another in a longitudinal direction of the sole plate.

11. The sole structure of claim 10, wherein the crests of the ridges are equally spaced from one another at any transverse cross-section of the sole plate through the ridges.

12. The sole structure of claim 1, wherein the grooves have crests at least some of which extend non-parallel with one another in a longitudinal direction of the sole plate.

13. The sole structure of claim 12, wherein the crests of the grooves are equally spaced from one another at any transverse cross-section of the sole plate through the grooves.

14. The sole plate of claim 1, wherein the ridges and the grooves are configured such that a thickness of the sole plate from the foot-facing surface to the ground-facing surface varies at a transverse cross-section of the sole plate through the ridges, or varies along a length of at least one of the ridges, or varies at both the transverse cross-section of the sole plate through the ridges and along the length of the at least one of the ridges.

15. The sole structure of claim 1, wherein the through hole is closer to a medial edge of the sole plate than to a lateral edge of the sole plate.

16. The sole structure of claim 1, wherein:

the foot-facing surface is concave in a longitudinal direction of the sole plate in the forefoot region; and the ground-facing surface is convex in the longitudinal direction of the sole plate in the forefoot region.

17. The sole structure of claim 1, wherein the ridges have crests at least some of which vary in amplitude in a longitudinal direction of the sole plate such that the amplitude is greater in a zone of the sole plate configured for relatively high compressive loads than in a zone of the sole plate configured for relatively low compressive loads.

18. The sole structure of claim 17, wherein at least some of the crests have an amplitude that is greater in a rearward portion of the forefoot region than in a forward portion of the forefoot region and greater than in the midfoot region.

19. The sole structure of claim 1, wherein the ridges have crests, and the sole plate is a resilient material such that the crests of the ridges decrease in elevation from a steady state elevation to a loaded elevation under a dynamic compressive load and return to the steady state elevation upon removal of the dynamic compressive load.

20. The sole structure of claim 1, wherein the sole plate has an absence of any additional ridges extending between and connecting adjacent ones of the ridges, and an absence of any additional grooves extending between and connecting adjacent ones of the grooves.

* * * * *